US008491359B2

(12) United States Patent
Feng et al.

(10) Patent No.: US 8,491,359 B2
(45) Date of Patent: Jul. 23, 2013

(54) POLISHING PAD, USE THEREOF AND METHOD FOR MAKING THE SAME

(75) Inventors: Chung-Chih Feng, Kaohsiung (TW); I-Peng Yao, Kaohsiung (TW); Yung-Chang Hung, Kaohsiung (TW); Lyang-Gung Wang, Kaohsiung (TW); Wen-Chieh Wu, Kaohsiung (TW)

(73) Assignee: Bestac Advanced Material Co., Ltd., Taoyuan County (TW)

( * ) Notice: Subject to any disclaimer, the term of this patent is extended or adjusted under 35 U.S.C. 154(b) by 253 days.

(21) Appl. No.: 12/862,098

(22) Filed: Aug. 24, 2010

(65) Prior Publication Data

US 2011/0045744 A1 Feb. 24, 2011

(30) Foreign Application Priority Data

Aug. 24, 2009 (TW) ..... 98128398 A

(51) Int. Cl.
*B32B 5/32* (2006.01)
*B24B 37/22* (2012.01)

(52) U.S. Cl.
USPC ..... 451/526; 451/532; 451/533; 428/217; 428/316.6

(58) Field of Classification Search
USPC ..... 428/217, 304.4, 316.6; 451/526, 451/532, 533; 51/295–297
See application file for complete search history.

(56) References Cited

U.S. PATENT DOCUMENTS

| | | | | |
|---|---|---|---|---|
| 6,358,130 | B1 | 3/2002 | Freeman et al. | |
| 2008/0200102 | A1* | 8/2008 | Feng et al. | 451/59 |
| 2008/0287047 | A1* | 11/2008 | Feng et al. | 451/532 |

FOREIGN PATENT DOCUMENTS

| | | | |
|---|---|---|---|
| CN | 1482958 | A | 3/2004 |
| CN | 1905991 | A | 1/2007 |
| CN | 101306518 | A | 11/2008 |
| TW | 200522184 | A | 7/2005 |
| TW | 200846138 | A | 12/2008 |
| WO | 02/051587 | | 7/2002 |

OTHER PUBLICATIONS

Office Action issued Mar. 27, 2012 to the corresponding Chinese Patent Application No. 200910176177.6 cites CN 1905991A and 101306518A.

English Abstracts of CN 1905991A and 101306518A.

Search Report issued Jan. 8, 2013 to the corresponding TW Patent application No. 098128398 cites TW 200846138A(corresponding to US 2008/0287047) and TW 200522184A (corresponding to US 2004/102137A1), Jan. 8, 2013.

English Abstract of Search Report issued Jan. 8, 2013 to the corresponding TW Patent application No. 098128398, Jan. 8, 2013.

Office action issued on Mar. 4, 2013 to the corresponding Chinese Patent Application No. 200910176177.6 which cites CN1482958A.

English Abstract Office action issued on Mar. 4, 2013 to the corresponding Chinese Patent Application No. 200910176177.6.

WO 02/051587 corresponds to CN1482958 A.

* cited by examiner

*Primary Examiner* — Pegah Parvini
(74) *Attorney, Agent, or Firm* — WPAT, P.C.; Anthony King

(57) ABSTRACT

The present invention relates to a polishing pad that comprises a polishing sheet for polishing a substrate, a buffer sheet comprising a plurality of holes, and adhesive for adhering the buffer sheet to the polishing sheet; wherein the adhesive is formed by polymerizing macromolecules with fluidity. A method of polishing a substrate comprising using the polishing pad and a method for manufacturing the polishing pad described above are also provided.

16 Claims, 4 Drawing Sheets

POLISHING PAD, USE THEREOF AND METHOD FOR MAKING THE SAME

BACKGROUND OF THE INVENTION

1. Field of the Invention

The present invention relates to a polishing pad for use in chemical mechanical polishing, use thereof and method for making the same.

2. Description of the Related Art

Chemical mechanical polishing (CMP) is a procedure for planarizing the surface of a substrate with a polishing pad. CMP is generally applied in polishing lenses, mirrors, substrates of liquid crystal displays, silicon wafers, and oxidation and/or metal layers on silicon wafers.

Taking silicon wafers as an example, ingots of monocrystalline silicon are sliced first. The wafers are usually lapped to make them flat for subsequently chemical etching. A polishing process is required after the etching process. During the polishing process, a polishing pad together with slurry reacts chemically with the silicon atoms on the surface of the wafer to make the reacted surface softer than the underlying silicon. Furthermore, the reacted surface is continually wiped away, causing fresh silicon to be exposed to the slurry and the polishing pad.

U.S. Pat. No. 6,358,130 discloses a conventional polishing pad for use with slurry. The conventional polishing pad has a polishing layer and a window in an opening through the polishing layer. The undersurfaces of the polishing layer and window are covered by an underlying fluid-impermeable layer. The conventional polishing pad further comprises adhesive on the fluid-impermeable layer forming respective bond seals between the polishing layer and the window and a lower backing layer. The adhesive and the fluid impermeable layer resist wetting of an interface between the adhesive and each of the polishing layer, the window and the fluid-impermeable layer in the conventional polishing pad. An advantage is that the fluid-impermeable layer, being uninterrupted, avoids a tendency to produce leakage paths due to bending during routine handling, or due to exertion of polishing pressure during use of the polishing pad, or due to small voids or gaps in the adhesive. A further advantage is that the bond seals minimize wetting by the slurry of the interface between the adhesive and each of the polishing layer, the window and the fluid-impermeable layer.

Because the lower backing layer of the conventional polishing pad usually comprises fibers, the contents of the lower backing layer are not distributed evenly. Also, because the polishing layer of the conventional polishing pad usually comprises elastomers, the contents of the polishing layer are not distributed evenly either. The variations of the thickness of the lower backing layer and polishing pad are easily observed. Besides, the surfaces of the lower backing layer and the polishing pad are not flat and usually rough and undulating. Such features make it difficult for the lower backing layer or polishing pad to attach tightly and completely to the fluid-impermeable layer. Bubbles and vacant space are easily observed in the interface between the lower backing layer and the polishing layer and the fluid-impermeable layer (as shown in FIG. 1). As a result, the slurry easily permeates into the interface between the lower backing layer and the polishing layer and the fluid-impermeable layer via the bubbles and vacant space. Therefore, the lifespan of the conventional polishing pad is shortened. The effect and efficiency of chemical mechanical polishing are both reduced thereby.

SUMMARY OF THE INVENTION

One object of the present invention is to provide a polishing pad comprising a polishing sheet, a buffer sheet and adhesive.

The polishing sheet comprises a polishing surface for polishing a substrate. The buffer sheet comprises a plurality of continuous holes, and the compression ratio of the buffer sheet is higher than the compression ratio of the polishing sheet. The adhesive is formed by polymerizing macromolecules with fluidity for adhering the buffer sheet to the polishing sheet.

Another object of the present invention is to provide a method of polishing a substrate comprising using the polishing pad described above to polish a surface of the substrate.

Still another object of the present invention is to provide a method for manufacturing the polishing pad described above comprising the steps of:

(a) providing the polishing sheet and the buffer sheet;

(b) applying the adhesive on a surface of the buffer sheet or the polishing sheet; and (c) adhering the buffer sheet to the polishing sheet.

The polishing pad according to the invention dramatically increases the adhering strength between the buffer sheet and the polishing sheet, and the flatness of the polishing pad and the stability of hardness are also raised. Additionally, the polishing pad according to the invention works without slurry permeation. The lifespan of the polishing pad is lengthened. The effect and efficiency of chemical mechanical polishing are both improved thereby.

DETAILED DESCRIPTION OF THE INVENTION

Figure 1:
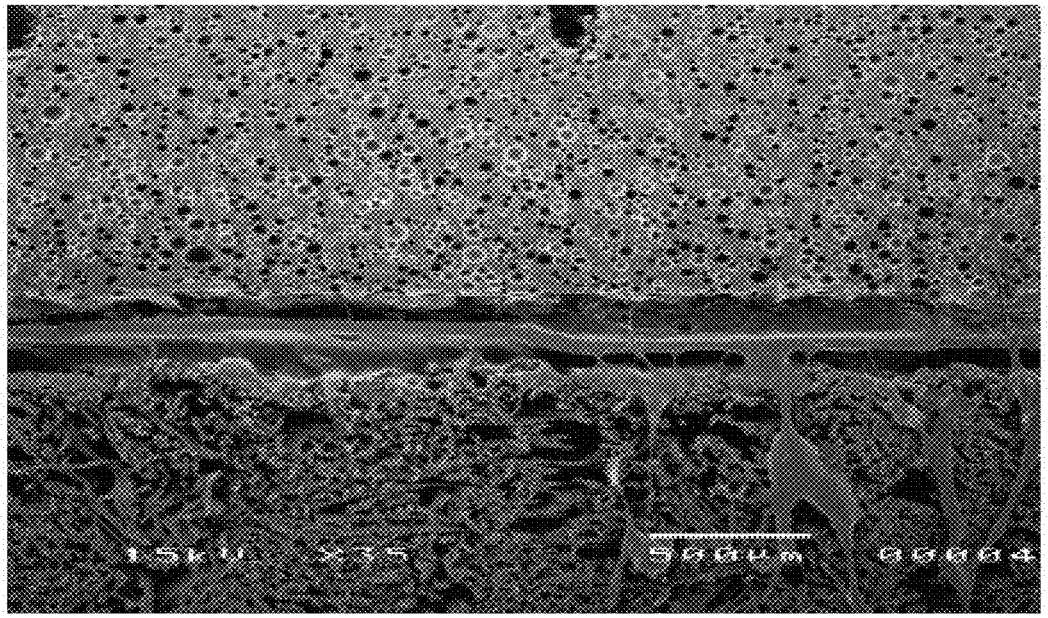
FIG. 1 (Prior art)
FIG. 1 illustrates a view under a transmission electron microscope of the conventional polishing pad.

The present invention provides a polishing pad comprising a polishing sheet, a buffer sheet and adhesive. The polishing sheet comprises a polishing surface for polishing a substrate. The buffer sheet comprises a plurality of continuous holes, and the compression ratio of the buffer sheet is higher than the compression ratio of the polishing sheet. The adhesive is formed by polymerizing macromolecules with fluidity for adhering the buffer sheet to the polishing sheet.

Polishing generally refers to a wear control for a preliminary coarse surface in the process of chemical mechanical polishing, which makes the slurry containing fine particles evenly dispersed on the upper surface of a polishing pad, and at the same time places a substrate against the polishing pad and then rubs the substrate repeatedly with a regular motion. A polishing device usually includes a lower base plate, a carrier film, a substrate, an upper base plate, a polishing pad and slurry. The carrier film is adhered to the lower base plate through an adhesive layer and is used for carrying and mounting the substrate. The polishing pad is mounted on the upper base plate.

The operation mode of the polishing device is as follows. First, the substrate is mounted on the carrier film, and then both the upper and lower base plates are rotated and the upper base plate is simultaneously moved downward, such that the polishing pad contacts the surface of the substrate, and a polishing operation for the substrate may be performed by continuously supplementing the slurry and using the effect of the polishing pad.

In one preferred embodiment of the invention, the polishing sheet comprises fibers. The fibers provide protrusions for polishing and also provide a scaffold allowing elastomers to be deposited in the space defined by the scaffold. Artisans skilled in this field can choose suitable kinds of fibers according to the disclosure of the specification. As used herein, the term "fibers" refers to single fibers or composite fibers, preferably composite fibers. The fibers are selected in accordance with the substrate to be polished. Preferably, the fibers are made of at least one material selected from the group consisting of polyamide, terephthalamide, polyester, polymethyl methacrylate, polyethylene terephthalate, polyacrylonitrile, and a mixture thereof. Preferably, the fibers are provided as a non-woven fabric, and more preferably, the polishing sheet comprises a rolled non-woven fabric. The rolled nonwoven fabric can be used in a roll-to-roll way that improves batch uniformity in comparison with a conventional method of producing a single polishing pad involving molding or casting.

As used herein, "a non-woven fabric" refers to a manufactured sheet, web or mat of directionally or randomly orientated fibers, bonded by friction, and/or cohesion and/or adhesion, excluding paper and products which are woven, knitted, tufted, stitch-bonded incorporating binding yarns or filaments, or felted by wet-milling, whether or not additionally needled. The fibers may be of natural or man-made origin. They may be staple or continuous filaments or be formed in situ. Depending on the method of forming the web, the nonwoven fabric usually comprises a composite nonwoven fabric, a needle-punched nonwoven fabric, a melt-blown nonwoven fabric, a spunbonded nonwoven fabric, a dry-laid nonwoven fabric, a wet-laid nonwoven fabric, a stitch-bonded nonwoven fabric, or a spunlace nonwoven fabric. Compared with a woven fabric, a non-woven fabric has a better material property.

In one preferred embodiment of the invention, the polishing sheet comprises a continuously porous elastomer. When collocated with the fibers, the elastomer and the fibers form a plurality of continuous pores. The continuous pores of the polishing pad have an even size, which benefit the flow of slurry and distribution of polishing particles and removal of polishing residues. In a preferred embodiment of the invention, the continuous pores have a pore size ranging from about 0.1 μm to about 500 μm. As used herein, the term "elastomer," refers to a type of polymer that exhibits a rubber-like quality. When polishing, the elastomer serves as a good buffer to avoid scraping the surface of the substrate to be polished. In one preferred embodiment of the invention, the elastomer comprises a foam resin. As used herein, the term "a foam resin" refers to a material containing a thermoplastic resin and a thermodecomposing foaming agent. The elastomer preferably comprises at least one selected from the group consisting of polyurethane, polyolefin, polycarbonate, polyvinyl alcohol, nylon, elastic rubber, polystyrene, polyaromatic molecules, fluorine-containing polymer, polyidmide, cross-linked polyurethane, cross-linked polyolefin, polyether, polyester, polyacrylate, elastic polyethylene, polytetrafluoroethylene, poly(ethylene terephthalate), polyaromatic amide, polyarylalkene, polymethyl methacrylate, a copolymer thereof, a block copolymer thereof, a mixture thereof, and a blend thereof; more preferably, the first elastomer comprises polyurethane.

The buffer sheet according to the invention comprises a plurality of continuous holes, and any sheet that has the compression ratio higher than the compression ratio of the polishing sheet is suitable for the invention. Because the compression ratio of the buffer sheet is higher than the compression ratio of the polishing sheet, the polishing sheet of the invention has a better buffer effect. When applied in the polishing procedure, it avoids the buffer sheet scraping the substrate to be polished. Preferably, the compression ratio of the buffer sheet is from about 20% to about 40%. In another aspect, the porosity of the buffer sheet is higher than the porosity of the polishing sheet, and the porosity of the buffer sheet is preferably from about 30% (v/v) to about 45% (v/v). The higher porosity also helps the polishing pad according to the invention to provide a better buffer effect. In still another aspect, the density of the buffer sheet is preferably from about 0.1 $g/cm^3$ to about 1.0 $g/cm^3$.

In one preferred embodiment of the invention, the buffer sheet comprises an elastomer. The elastomer preferably comprises a plurality of continuous pores and the compression ratio thereof is higher than the compression ratio of the polishing sheet. The elastomer can be applied alone or incorporated with other materials to provide the buffer sheet. Preferably, the elastomer comprises at least one selected from the group consisting of polyurethane, polyvinyl chloride, polystyrene, polyethylene, polyamide, polyether, polypropylene, ethylene/vinyl acetate, a copolymer thereof, a block copolymer thereof, a mixture thereof, and a blend thereof.

In one preferred embodiment of the invention, the buffer sheet comprises a carrier for a continuous porous structure formed thereon; for example, for the elastomer as mentioned above formed thereon. Preferably, the carrier is selected from the group consisting of a film, a woven fabric and a glass fiber. Preferably, the film comprises at least one selected from the group consisting of polypropylene, polyethylene terephthalate, acrylics, and polyolefin.

The polishing pad according to the invention comprises the adhesive formed by polymerizing macromolecules with fluidity for adhering the buffer sheet to the polishing sheet. Because the adhesive has fluidity prior to polymerization, when adhering the polishing sheet and the buffer sheet, the adhesive is preferably embedded into the pores of the buffer sheet and/or the polishing sheet. Because the adhesive according to the invention is preferably embedded into the pores of the buffer sheet and/or polishing sheet, it serves as an intermediate between the buffer sheet and/or the polishing sheet. The adhesive according to the invention is designed to modify the surface of the buffer sheet and/or the polishing sheet, and is able to fill rough and undulating points of the buffer sheet and the polishing sheet. Therefore, these two sheets can be adhered to each other well. Compared with the conventional adhesive comprising a fluid-impermeable layer, the adhesion strength of the buffer sheet and the polishing sheet is dramatically enhanced. Moreover, the polishing pad according to the invention works without slurry permeating it. The lifespan of the polishing pad is lengthened. The effect and efficiency of chemical mechanical polishing are both improved thereby.

Additionally, the polishing sheet and the buffer sheet of the invention are provided solely, and the hardness or compression ratio can be adjusted to broaden the application.

In one preferred embodiment of the invention, the viscosity of the macromolecules with fluidity prior to polymerization is from about 14000 cps to about 18000 cps.

In another aspect, the adhesive is selected from the group consisting of pressure sensitive adhesive, single-part adhesive, two-part adhesive, acrylic resin, and epoxy resin. The pressure sensitive adhesive usually comprises a carrier film containing polyester (for example), and adhering layers with fluidity formed on the upper and lower surfaces of the carrier film. The single-part adhesive refers to adhesive using macromolecular elastomer as paste. Preferably, the single-part adhesive comprises polyurethane. The single-part adhesive comprises oil-modified adhesive and wet-curing adhesive. The oil-modified adhesive is provided by reacting polyol and toluene diisocyanate (TDI), and wherein the polyol is modified by natural oil or diglyceride. The wet-curing adhesive comprises polyester with hydroxyl groups and polyether, and it uses excess NCO groups (NCO/OH>1) to react with hydroxyl groups in toluene diisocyanate, diphenylmethane diisocyanate (MDI), or hexamethylene diisocyanate (HMDI) to form a pre-polymerized component with an isocyanate group in the terminals. The isocyanate group reacts with the wet in the air to form an amine bond and urea. It further forms biuret to provide the cured adhesive. The two-part adhesive refers to adhesive comprising two components that interact or cross link with each other to provide adhesive. Preferably, it contains an elastomer and polyisocyanate. The two-part adhesive comprises a catalytic curing type where polyethylene glycol, polypropylene glycol, or polyol estered mono diglyceride reacts with a tertiary amine and metal salts to catalytically cure. Polyol-curing PU is formed by reacting isocyanate prepolymer, polyol-ester or polyether and acrylate containing OH groups. The acrylic resin contains a normal-temperature hardening type and a hot hardening and drying type. The normal temperature hardening type comprises mainly acrylate monomer, and the hot hardening and drying type comprises acrylate polymer where an active group is introduced and forms a 3-dimensional net structure by hotting the acrylate or reacting the acrylate with a cross-linking agent. The is epoxy resin can also from a 3-dimensional structure by adding a cross-linking agent.

The present invention also provides a method of polishing a substrate comprising using the polishing pad mentioned above to polish a surface of the substrate.

The present invention also provides a method for manufacturing the polishing pad described above comprising the steps of:

(a) providing a polishing sheet and a buffer sheet, said polishing sheet comprising a polishing surface, which polishing surface is used for polishing a substrate, said buffer sheet comprising a plurality of continuous holes, wherein the compression ratio of the buffer sheet is higher than the compression ratio of the polishing sheet;

(b) applying adhesive on a surface of the polishing sheet or the buffer sheet, which adhesive is provided by polymerizing macromolecules with fluidity; and (c) adhering the buffer sheet to the polishing sheet.

The manner of adhering the buffer sheet to the polishing sheet varies according to the form of the adhesive. The adhesive for adhering the buffer sheet to the polishing sheet is preferably applied on at least one surface of the buffer sheet and the polishing sheet by coating, spraying, printing or scraping.

After applying the adhesive, the buffer sheet and the polishing sheet are adhered together. The buffer sheet and the polishing sheet are preferably adhered to each other at a temperature from 75° C. to 80° C.

If necessary, after step (c) according to the invention, the method further comprises a curing step. In some cases, the adhesive needs the curing step to solidify and form the bonding. The condition and manner of the curing step varies according to the adhesive used.

The following examples are given for the purpose of illustration only and are not intended to limit the scope of the present invention.

Polishing sheet: the polishing sheet is obtained by filling polyurethane into a non-woven fabric and curing.

Buffer sheet: a PET woven fabric with 2.50 to 3.00 denies is taken as a carrier and coating 19.9 wt % of coating polyurethane, 6.6 wt % of pigments, 2.5 wt % of surface active agent and 71 wt % of dimethylformamide to form a resin layer. The resin layer is cured in the presence of 10 wt % of dimethylformamide and a continuous porous buffer sheet is formed by washing at 70° C. and drying at 110° C.

Adhesive: the polyurethane is formed on the buffer sheet by printing or coating, and then adhering to the polishing sheet.

Figure 2:
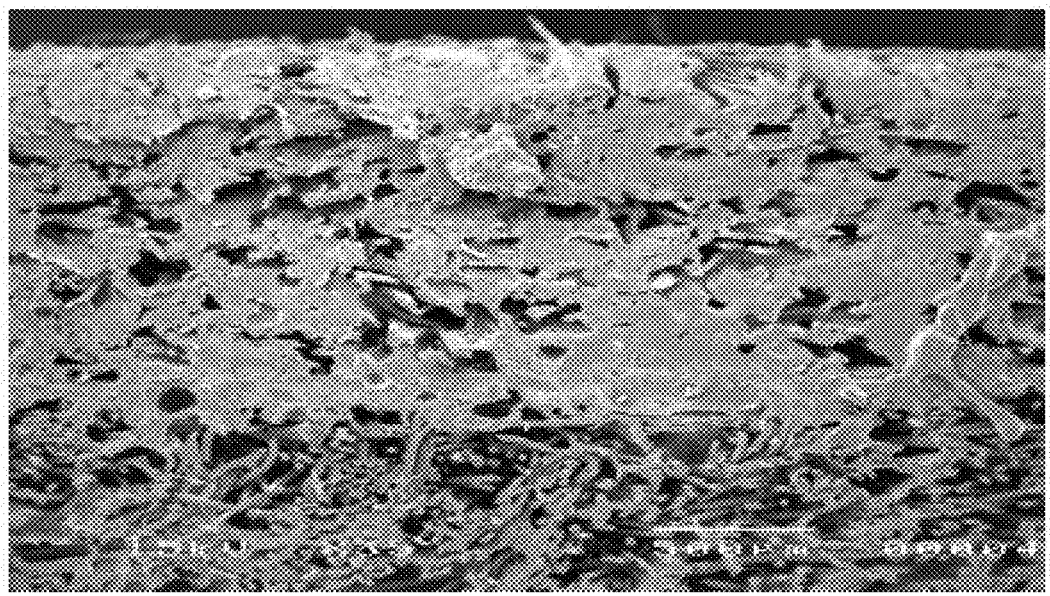
FIG. 2 illustrates a view under a transmission electron microscope of the polishing pad according to the invention.
Figure 3:
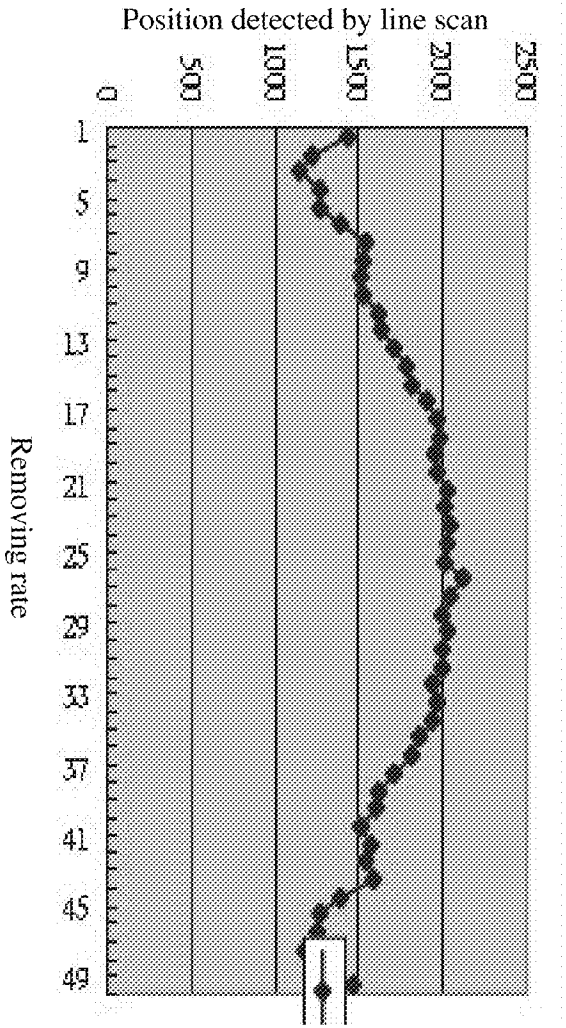
FIG. 3 (Prior art)
FIG. 3 illustrates the relationship between the position and the removing rate of the conventional polishing pad detected by line scan.
Figure 4:
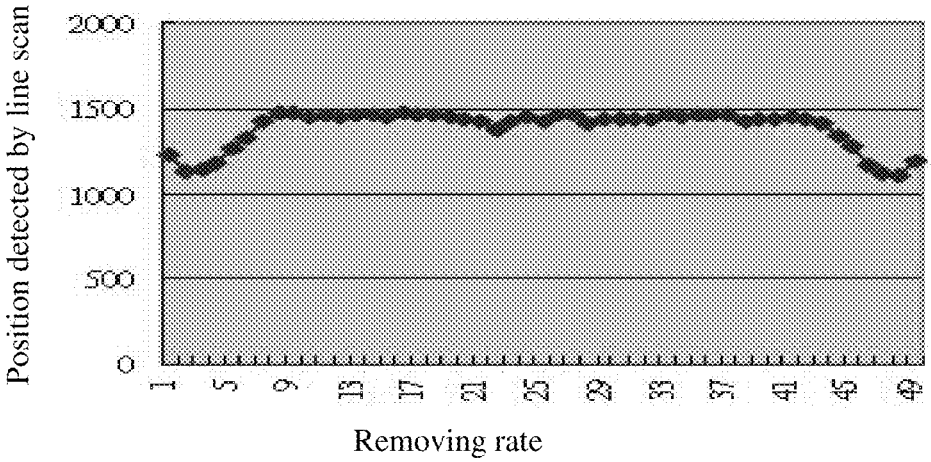
FIG. 4 illustrates the relationship between the position and the removing rate of the polishing pad according to the invention detected by line scan.

The polishing pad according to the invention is shown in FIG. 2.

Comparative Example

Conventional RODEL® IC1000 Polishing Pad (FIG. 1)

Table 1 shows the properties of the conventional polishing pad (Pad 1) and the polishing pad according to the invention (Pad 2).

TABLE 1

| | | |
|---|---|---|
| Wafer P | 3.7 | |
| ΔP | 0.15 | |
| Wafer RPM | 5 | |
| Polishing pad RPM | 400 | |
| Slurry (M/m) | 200 | |
| Polishing pad | Pad 1 | Pad 2 |
| R.R (Å/min) | 807.45 | 1385 |
| NU (Non-Uniformity %) | 12.07% | 7.96% |

Referring to Table 1, the non-uniformity of the polishing pad according to the invention is significantly improved compared with the conventional polishing pad. The flatness of the polishing pad and the stability of hardness are also raised. Additionally, the polishing pad according to the invention works without slurry permeating it. The lifespan of the polishing pad is lengthened. The effect and efficiency of chemical mechanical polishing are both improved thereby.

While embodiments of the present invention have been illustrated and described, various modifications and improvements can be made by persons skilled in the art. The embodiments of the present invention are therefore described in an illustrative but not restrictive sense. It is intended that the present invention is not limited to the particular forms as illustrated, and that all the modifications not departing from the spirit and scope of the present invention are within the scope as defined in the appended claims.

What is claimed is:

1. A polishing pad comprising:

a polishing sheet comprising a polishing surface, which polishing surface is used for polishing a substrate;

a buffer sheet comprising a plurality of continuous holes, wherein the compression ratio of the buffer sheet is higher than the compression ratio of the polishing sheet; and adhesive for adhering the buffer sheet to the polishing sheet; wherein the adhesive is formed by polymerizing macromolecules with fluidity;

wherein the porosity of the buffer sheet is from about 30% (v/v) to about 45% (v/v).

2. The polishing pad according to claim 1, wherein the polishing sheet comprises a non-woven fabric.

3. The polishing pad according to claim 1, wherein the polishing sheet comprises a continuously porous elastomer.

4. The polishing pad according to claim 3, wherein the continuously porous elastomer comprises at least one selected from the group consisting of polyurethane, polyolefin, polycarbonate, polyvinyl alcohol, nylon, elastic rubber, polystyrene, polyaromatic molecules, fluorine-containing polymer, polyidmide, cross-linked polyurethane, cross-linked polyolefin, polyether, polyester, polyacrylate, elastic polyethylene, polytetrafluoroethylene, poly(ethylene terephthalate), polyaromatic amide, polyarylalkene, polymethyl methacrylate, a copolymer thereof, a block copolymer thereof, a mixture thereof, and a blend thereof.

5. The polishing pad according to claim 1, wherein the compression ratio of the buffer sheet is from about 20% to about 40%.

6. The polishing pad according to claim 1, wherein the porosity of the buffer sheet is higher than the porosity of the polishing sheet.

7. The polishing pad according to claim 1, wherein the density of the buffer sheet is from about 0.1 $g/cm^3$ to about 1.0 $g/cm^3$.

8. The polishing pad according to claim 1, wherein the buffer sheet comprises an elastomer, and the elastomer comprises at least one selected from the group consisting of polyurethane, polyvinyl chloride, polystyrene, polyethylene, polyamide, polyether, polypropylene, ethylene/vinyl acetate, a copolymer thereof, a block copolymer thereof, a mixture thereof, and a blend thereof.

9. The polishing pad according to claim 1, wherein the buffer sheet comprises a carrier.

10. The polishing pad according to claim 9, wherein the carrier is selected from the group consisting of a film, a woven fabric and a glass fiber.

11. The polishing pad according to claim 10, wherein the film comprises at least one selected from the group consisting of polypropylene, polyethylene terephthalate, acrylics, and polyolefin.

12. The polishing pad according to claim 1, wherein the viscosity of the macromolecules with fluidity prior to polymerization is from about 14000 cps to about 18000 cps.

13. The polishing pad according to claim 1, wherein the adhesive is selected from the group consisting of pressure sensitive adhesive, single-part adhesive, two-part adhesive, acrylic resin, and epoxy resin.

14. The polishing pad according to claim 13, wherein the single-part adhesive comprises polyurethane.

15. The polishing pad according to claim 13, wherein the two-part adhesive comprises an elastomer and polyisocyanate.

16. A method of polishing a substrate comprising using the polishing pad according to claim 1 to polish a surface of the substrate.

* * * * *